United States Patent [19]

Mitsuhashi et al.

[11] 4,206,247

[45] Jun. 3, 1980

[54] ELECTROPHOTOGRAPHIC PROCESS

[75] Inventors: Yasuo Mitsuhashi, Yokohama; Masashi Kiuchi, Toride, both of Japan

[73] Assignee: Canon Kabushiki Kaisha, Tokyo, Japan

[21] Appl. No.: 913,231

[22] Filed: Jun. 6, 1978

[30] Foreign Application Priority Data

Jun. 8, 1977 [JP] Japan ..... 52/67587
Jun. 8, 1977 [JP] Japan ..... 52/67588
Jun. 8, 1977 [JP] Japan ..... 52/67589

[51] Int. Cl.[2] ..... G03G 13/16; G03G 13/20; G03G 9/08

[52] U.S. Cl. ..... 430/120; 106/218; 106/230; 260/27 R; 260/27 EV; 260/101; 260/104; 430/109; 430/124

[58] Field of Search ..... 427/14, 22, 24, 18; 252/62.1 P; 96/15 D, 1.4; 260/27 R, 27 EV, 101, 104; 106/230, 239, 218

[56] References Cited

U.S. PATENT DOCUMENTS

| | | | |
|---|---|---|---|
| 3,510,338 | 5/1970 | Varron et al. | 252/62.1 P |
| 3,873,325 | 3/1975 | Westdale | 252/62.1 P |
| 3,965,021 | 6/1976 | Clemens et al. | 252/62.1 P |
| 3,993,483 | 11/1976 | Maki et al. | 252/62.1 P |
| 4,022,738 | 5/1977 | Shimada et al. | 252/62.1 P |
| 4,108,653 | 8/1978 | Peters | 427/22 |

*Primary Examiner*—Ronald H. Smith
*Assistant Examiner*—Stuart D. Frenkel
*Attorney, Agent, or Firm*—Fitzpatrick, Cella, Harper & Scinto

[57] ABSTRACT

An electrophotographic process comprises the steps of: developing an electric latent image with toner particle, the toner particle comprising 20–70 parts by weight of at least one resin selected from resins of Group A and 80–30 parts by weight of at least resin selected from resins of Group B, transferring the developed toner image to a paper having a smoothness of 5–130 seconds (measured by Bekk method), applying pressure to the transferred toner image to fix the toner image on said paper, and repeating at least said steps, in which said resins of Group A includes a low molecular weight polyethylene, a low molecular weight polypropylene, ethylene-ethyl acrylate copolymer, ionomer resin and ethylenevinyl acetate copolymer, and said resins of Group B includes natural resin modified maleic acid resin, natural resin modified pentaerythritol resin and natural resin modified glycerine resin.

6 Claims, No Drawings

ELECTROPHOTOGRAPHIC PROCESS

BACKGROUND OF THE INVENTION

1. Field of the Invention

This invention relates to an electrophotographic process, electrostatic printing process or the like, and more particularly, to a copying process which comprises developing an electric latent image with toner particle, transferring the developed image to a paper and fixing the transferred image mainly by means of pressure.

2. Description of the Prior Art

Heretofore, various electrophotographic processes have been known. For example, U.S. Pat. Nos. 2,297,691, 2,576,047 and 3,081,698, and Japanese Patent Publication Nos. 23910/1967 and 24784/1968 disclose electrophotographic processes. In general, these electrophotographic processes utilize a photoconductive material as a photosensitive material and comprise forming an electric latent image on a photosensitive member including the photoconductive material by various image-forming means, developing the latent image with a toner, and if desired transferring the toner image to a transferring material such as paper, and further fixing the transferred image by, for example, heating, pressing or applying a solvent vapor so that a copy is obtained.

Also, these are known various methods for visualizing an electric latent image with a toner, and they includes many developing methods, for example, magnetic brush method disclosed in U.S. Pat. No. 2,874,063, cascade developing method proposed in U.S. Pat. No. 2,618,552, powder cloud method disclosed in U.S. Pat. No. 2,221,776, fur brush developing method, liquid developing method and the like. The toner used in these developing methods is fine powder prepared by dispersing a coloring material such as a dye and pigment in natural or synthetic resin. Further, it is known that a developing powder containing a third substance added for various purposes is used as the toner.

The developed toner image is transferred to a transferring material such as paper if desired, and then fixed. As the method for fixing the toner image, there are known a method of heat-melting the toner of the image by means of a heater or heat roller to cause it to deposit and solidify on a substrate, a method of softening or dissolving the toner with an organic solvent to fix it on a substrate, a method of pressing the toner onto a substrate to effect the fixation, and the like.

These toners are prepared from different material selected in accordance with the kind of fixing method to be applied. Therefore, in general it is not possible to utilize the toner suitable for one fixing method as that for the other fixing methods. Particularly, the toner suitable for the heat-melting fixing method using a heater as conventionally used in wide range can be hardly utilized in the heat roller fixing method, solvent fixing method, pressure fixing method and the like. Consequently, toners suitable for various fixing methods are studied and developed.

Among those fixing methods, the method using a solvent is excellent in that a toner can be perfectly fixed by a small quantity of energy, but has such a drawback that the solvent vapor escapes from the copying machine to pollute the surroundings. Further, the fixing method using heat which is the most common fixing method is advantageous in that a toner can be perfectly fixed. But, in such fixing method, a large quantity of energy is required, and it takes long time to heat the fixing apparatus up to a temperature at which toner can be fixed, and further the temperature of the periphery of the fixing apparatus becomes too high, which are drawbacks inherent to this fixing method.

The method for fixing a toner by applying pressure thereto is disclosed in U.S. Pat. No. 3,269,626 and Japanese Patent Publication No. 15876/1971 and is advantageous in many aspects. For example, only a very small quantity of energy is required so that economy of energy is possible; the air pollution is avoided; copying can be made immediately after the electric power is supplied to the copying machine; risk of a copy being burned is eliminated; high speed fixation is possible; and a fixing apparatus is simple.

In the pressure fixing method, however, the problems to be resolved are pointed out, for example insufficient fixability of a toner and offset phenomena of a toner to a pressure roller. Various studies and developments are made for the purpose of improving the fixability of a toner under pressure.

Heretofore, various methods for fixing a toner by applying pressure thereto have been proposed. For example, British Pat. No. 1,210,665 proposes a pressure fixing method which uses a toner comprising an aliphatic compound having 6–25 carbon atoms; Japanese Patent Publication No. 11493/1976 discloses a pressure fixing method which employs a toner comprising polyamide, a certain brittle resin, and polyethylene or polymethylene, Japanese Patent Laid Open No. 64931/1976 discloses a pressure fixing method which is applied to a toner comprising a low molecular weight polyolefine and terpene series resin; Japanese Patent Laid Open No. 137421/1976 proposes a pressure fixing method which is applied to a toner comprising a low molecular weight polyolefine or its copolymer, and an aliphatic hydrocarbon resin; Japanese Patent Laid Open No. 88228/1976 proposes a pressure fixing method which uses a toner comprising polyamide and polyester resin; U.S. Pat. No. 3,928,656 proposes a pressure fixing method which uses a toner comprising amorphous polymer having a weak bond strength of 2–30 Kcal/mol and exhibiting a second order transition point (Tg) higher than $-20°$ C. ($Tg > -20°$ C.).

However, a pressure fixable toner for practical application has not been obtained which is advantageous in the following points: the toner can be easily prepared; it does not adhere to the pressure roller; it shows stable developability and fixability even in repeated use; it does not adhere or deposit to the carrier, metal sleeve and photosensitive member surface; it neither agglomerates nor cakes during storage; and it is excellent in storage stability.

Consequently, in the pressure fixing method practically applied at the present time, an electrostatic latent image which is formed on a zinc oxide-coated paper and developed with an electrically conductive magnetic toner is fixed by means of a pressure roller. This method uses a zinc oxide-coated paper as a substrate for a final image, and therefore it is totally different from the method for fixing a final image on an ordinary paper. Under existing circumstances, the pressure fixing method on an ordinary paper is not put into practice.

A toner comprising a soft material is excellent in pressure fixability, but various problems to be resolved are pointed out. For example, the soft material is difficult to grind to a toner powder, and the offset phenomenon of such toner to a pressure roller is liable to occur, and also such toner tends to adhere to the carrier and photosensitive member surface. Further problem is that such toner agglomerates and cakes during the storage thereof.

Another toner comprising a hard resin in excellent in chargeability and storage stability, and the hard resin is easy to grind to toner particle. However, such toner is inadvantageously very poor in pressure fixability for the reason that since the used resin is, in most cases, hard as compared with the cellulose fiber forming paper, it is merely crushed into paper in applying pressure thereto, but is not caught in the fiber.

Further, as for the known capsule toner of pressure fixability, when the core material is formed from a soft material exhibiting good pressure fixability the soft material gradually adheres onto a pressure roller during repeated practice of the pressure fixing method, which inadvantageously causes the offset phenomenon of the toner and the winding phenomenon of the transferring paper around the pressure roller. On the other hand, when these phenomena are avoided, the pressure fixability of the toner becomes deteriorated. Under circumstances, a practical capsule toner has not been obtained as yet.

Recently, an electrostatic latent image is developed with a developer of one component system in which magnetic fine particles is contained in a toner without carrier particles. In this case, however, the binder resin for the toner is required to have sufficient dispersibility and adhesion property to the magnetic particles, and further the toner should show good impact resistance and fluidity. Therefore, it is considerably difficult to make those properties compatible with the pressure fixability.

SUMMARY OF THE INVENTION

An object of the present invention is to provide a copying process in which a toner is used which is different from the conventional pressure fixable toner in the constituting material and free from the foregoing drawbacks, the image developed with such toner is transferred to a paper having a specified smoothness and fixed by applying pressure thereto.

Another object of the present invention is to provide a pressure fixable toner having a remarkably excellent pressure fixability onto a paper and maintaining stable developability and fixability even after a great many of copies are made.

A further object of the present invention is to provide a pressure fixable toner free from the offset phenomenon to a pressure roller as well as adhesion phenomenon to a carrier, developing sleeve and photosensitive member surface.

Still another object of the present invention is to provide pressure fixable toner which is excellent in storage stability and therefore neither aggregates nor cakes during storage thereof.

A still further object of the present invention is to provide a pressure fixable toner which is excellent in chargeability and besides shows always stable chargeability during use thereof and further provides a clear image free from fog.

Still another object of the present invention is to provide a pressure fixable toner which shows excellent pressure fixability and has good magnetic property and further is capable of being transferred electrostatically even when the toner is a magnetic toner of one component system containing magnetic fine particles.

A still further object of the present invention is to provide a pressure fixable toner which is excellent in impact resistance as well as fluidity property.

According to the present invention, there is provided an electrophotographic process which comprises the steps of:

developing an electric latent image with toner particle, the toner particle comprising 20–70 parts by weight, preferably 25–50 parts by weight of at least one resin selected from resins of Group A and 80–30 parts by weight, preferably 75–50 parts by weight of at least one resin selected from resins of Group B, transferring the developed image to a paper having a smoothness of 5–130 seconds (measured by Bekk method), preferably 10–90 seconds, particularly preferably 10–60 seconds, fixing the transferred image on said paper mainly by applying pressure, and repeating at least said steps, in which said resins of Group A includes a low molecular weight polyethylene, a low molecular weight polypropylene, ethylene-ethyl acrylate copolymer, ionomer resin and ethylene-vinyl acetate copolymer, and said resins of Group B includes natural resin modified maleic acid resin, natural resin modified pentaerythritol resin and natural resin modified glycerine resin.

In addition, the smoothness of the paper is measured in accordance with the procedure prescribed in JIS, P 8119 (Bekk method). DESCRIPTION OF THE PREFERRED EMBODIMENTS The resin of Group A used in the present invention is excellent in pressure fixability and also good in chargeability. However, when only such resin is used as a binder resin to prepare a toner, the resulting toner is inadvantageously remarkable in agglomeration and therefore is not practically applicable as a pressure fixing toner. On the other hand, if the amount of the pigment in the toner is increased for the purpose of decrease the inadvantageous agglomeration degree of the toner, the pressure fixability and chargeability of the toner are deteriorated unfavorably.

For the purpose of eliminating the above-mentioned drawbacks, the resins of Group A were mixed with another resin in various ratios to test the usefulness of the mixture as a binder resin. As the result, a great majority of mixtures were found to deteriorate extremely the pressure fixability of the toner or have adverse influence on the developability, storage stability, fluidity property, impact resistance, adhesion of the toner to a photosensitive member etc., and therefore, they are not preferable in practical application.

However, the resins of Group B as mentioned above were found to be advantageously useful. That is, the resins of Group A were mixed with those of Group B in a specified ratio, and the mixtures were examined with respect to the usefulness thereof as a binder resin for a toner. The toner prepared by using the mixtures was perfectly improved in the agglomeration property and particularly showed a remarkably excellent pressure fixability to a speficied paper having a specified smoothness (5–130 seconds, measured by Bekk method). Further, the other properties of such toner was found to be sufficiently practical.

The reason why the toner using the mixture of the resins of Groups A and B as the binder is remarkably excellent in the pressure fixability to a paper may be considered as follows. When pressure is applied to the toner particles, the particle is destroyed mainly in the portion of the brittle resin of Group B to provide a remarkably fine particle of the resin of Group A, and as a result such fine particle is caused to penetrate into the fiber of the rough paper and caught in the fiber, which mechanism may be considered to provide a toner with excellent fixability. Particularly, when the toner having the resin of Group A into which the resin of Group B is dispersed is destroyed by pressure, the resin of Group A becomes contact with the fiber of the paper in the increased contact area, from the fact of which excellent fixability of the toner is considered to be obtained. Therefore, where the used paper has a smoothness of 130 seconds or below, preferably of 90 seconds or below, the toner shows particularly excellent fixability. On the contrary, if the used paper has a smoothness of more than 130 seconds, and where a coat paper and art paper are used, the fixability exhibited by the toner is considered to be undesired. Further, since a paper having a smoothness of less than 5 seconds is too rough in the surface, such a paper is not useful as a transferring paper in view of the transferrability of a toner image.

Moreover, in the mixture of the resins of Groups A and B, when the amount of Group A resin is smaller than 20 parts by weight, particularly 25 parts by weight, the fixability of the toner as well as the chargeability are inadvantageously insufficient for practical application. In addition, where the amount of Group A resin is larger than 70 parts by weight, particularly 50 parts by weight the improvement in the agglomeration of the toner is insufficient, and compatibility between the resins of Groups A and B becomes poor. Also, in that case, the resin mixture is considerably difficult to grind to a toner powder. Besides, the synergetic effect of the pressure fixability due to the mixing Group A resin with Group B resin becomes unremarkable.

In the resins of Group A used in the present invention, the polyethylene and polypropylene may have a molecular weight of 1,000–10,000, generally of 1,000–5,000.

In the toner of the present invention, besides the resins of Groups A and B, another resin, wax and the like may be incorporated to the extent that the effect of the present invention is not eliminated. It is noted, however, that the resins of Groups A and B should be present in an amount of larger than 60% by weight, preferably 80% by weight based on the weight of the binder resin for toner.

As the resins to be incorporated, there may be mentioned, for example, polystyrene resin, styrene series copolymer, polyester resin, epoxy resin, silicone resin, polyurethane resin, a low molecular weight polymethylene, rosin, polyterpene, cumarone-indene resin, cyclopentadiene resin, and waxes.

As the coloring agent used for the toner of the present invention, all kinds of dyes and pigments heretofore known as such a coloring agent may be used, for example, carbon black, nigrosine, a metal complex of monoazo dye, iron oxide black, ultramarine, graphite, phthalocyanine blue, chrome yellow, benzidine yellow and quinacridone series organic pigment.

Hydrophobic silica fine particles may be adhered fast to the surface of the toner particles to obtain a toner which is further improved in the agglomeration and impact resistance. However, when the toner particles are merely mixed with the hydrophobic silica fine particles, the resulting toner becomes undesirably deteriorated in its effect if a great many of copies are made with the toner. Therefore, it is preferable to cause the silica fine particles to adhere fast to the surface of the toner particles, for example in such a manner that the particles of the two are floated and suspended in gas to form a fluidized bed, under states of which heating is conducted to the extent that the toner particles are softened.

What is meant by the "hydrophobic silica fine particle" is fine powder comprising silicon dioxide which has an average particle size of some 1–100 mμ and composition in which the hydrogen of the silanol group present in the surface of the fine particle is replaced by an alkyl group. As the hydrophobic silica fine particle, there may be mentioned, for example R-972 (trade name, supplied by Japan Aerosil K. K.), Tullanox 500 (trade name, supplied by Tulco Inc.), Silanox 104 (trade name, supplied by Cabot Corp.) and the like.

The hydrophobic silica fine particle may be mixed in an amount of 1–20 parts by weight, preferably 3–15 parts by weight based on 100 parts by weight of the toner particle.

The technique for forming a fluidized bed of powder is described in, for example, Hideo Nagasaka, "Powder Coating (Funmatsu Toso)", issued by Nikkan Kogyo Shinbunsha in Japan.

The softening temperature of the toner particle in the present invention may be measured by the microscopic method. That is, a sample of the toner particle is gradually heated while it is observed by a microscope. As a result, the edge of the particle is melted and rounded. The temperature at that time may be determined as the softening point of the toner particle.

The hydrophobic silica fine particles can be, theoretically, caused to adhere fast onto the toner particle surface at the softening temperature of the toner particle measured in the above mentioned manner, but in view of the productivity, it is preferable to do so at a temperature higher than the softening temperature. An appropriate temperature for that purpose varies depending on the rheological property of the selected resin upon heat-melting, and therefore, it is not possible definitively to specify the difference between the appropriate temperature and the softening temperature. But, in view of the fact that the hydrophobic silica particle is, thermally, caused to adhere fast onto the toner particle, the suitable temperature may be a temperature at which the surface of the toner particle is softened to an extent enough for the silica particle to adhere locally to the toner particle, and therefore further higher temperature is not required.

In the present invention, where a magnetic toner is desired, magnetic fine particles may be incorporated into the toner. The magnetic material may be that having magnetism or capable of being magnetized, for example, metal fine powder such as iron, manganese, nickel, cobalt, chromium and the like; various alloys and compounds of iron, cobalt, nickel, manganese and the like such as various ferrites and magnetite; the other ferromagnetic alloys; and the other magnetic materials known in the art. The magnetic material is ground to fine powder having an average particle size of about 0.1–5 microns, preferably 0.1–1 micron, and it may be added in an amount of about 1–50% by weight, preferably 5–40% by weight based on the weight of the toner.

In the present invention, a toner particle may be prepared in the known method or may be formed into a capsule toner.

The toner may be generally about 0.5–100 microns, preferably about 1–40 microns in its particle size.

In the present invention, the process for forming an electric latent image (electrostatic latent image) is not restricted at all, and therefore, the known conventional processes may be utilized.

Also, the process for transferring a toner image obtained by the development of an electric latent image onto a transferring paper is not limited at all, but the corona transferring method is preferred.

The toner image on the transferring paper is fixed mainly by pressure. That is, the toner image is caused to pass through a pair of rollers to which pressure is applied. At this time, heat may be also applied complemently.

The pressure fixing devices are disclosed in Japanese Patent Publication No. 12797/1969, U.S. Pat. Nos. 3,269,626, 3,612,682, 3,655,282, 3,731,358 and so forth. These devices may be used in the present invention.

The invention will be understood more readily by reference to the following examples. However, these examples are intended to illustrate the invention and are not to be construed to limit the scope of the invention.

EXAMPLE 1

In a roll mill, 30 parts by weight of ethylene-ethyl acrylate copolymer (trade name: DPDJ-6169, supplied by Nippon Unicar K. K.) and 70 parts by weight of natural resin modified maleic acid resin (trade name: Beckacite 1110, supplied by Japan Reichhold Chemicals Inc.) and 5 parts by weight of carbon black were melted and kneaded. The kneaded mixture was roughly ground by using a hammer mill, and further was finely pulverized by an air-jet pulverizer. The resulting colored fine powder was classified to select particles having a size of 5–20 microns, which particles were used as a toner. 12 parts by weight of this toner was mixed with 88 parts by weight of iron powder carrier (trade name: EFV 250–400) to prepare a developer. The tribo-electric charge of the toner was found to be $-5.2\ \mu c/g$.

An image developed with the thus prepared developer, but not yet fixed, was obtained on a high quality paper having a smoothness of some 40 seconds by using a dry type electrophotography copying machine for ordinary paper (trade name: NP5000, supplied by Canon K. K.). The developed image was fixed by application of a pressure of 300 $kg/cm^2$ by using a pressure fixing device of a commercially available copying machine (trade name: AM-5000, supplied by Addressograph Multigraph Corp.). As a result, an fixed image was obtained which was excellent in the fixability and free from fog. Even when 30,000 sheets of copy were made continuously with use of the same developer, the pressure fixability of the image remained excellent. In addition, the initial image density and fog density were measured by a reflection densitometer to found to be 1.70 and 0.03, respectively. The fixability was measured in accordance with the color fastness test with respect to rubbing (JIS-L, 0849-1971). More particularly, the surface of the fixed toner was rubbed with a white cotton cloth by using a rubbing tester in accordance with the prescribed operation (dry test), and the colored degree of the white cotton cloth was measured by a reflection densitometer. As a result, the fixability was 0.25.

EXAMPLES 2–16

The same procedure as that in Example 1 was repeated except that the resin for the toner was replace by various combinations of the resins of Groups A and B and the smoothness of the transferring paper was changed. The combination of the resins and the changed smoothness are shown in the table given below.

30,000 sheets of copy was made continuously. Even thereafter, a clear, fogless image can be obtained which was practically sufficient also in the fixability.

| Example No. | Resin of Group A (parts by weight) | Resin of Group B. (parts by weight) | Smoothness of transferring paper | Fixability | Image density | Fog density |
|---|---|---|---|---|---|---|
| 2 | Ethylene-ethyl acrylate copolymer (40) | Natural resin modified pentaerythritol resin (60) | about 80 (sec) | 0.21 | 1.69 | 0.03 |
| 3 | Ethylene-ethyl acrylate copolymer (60) | Natural resin modified glycerine resin (40) | about 60 | 0.12 | 1.52 | 0.02 |
| 4 | Ethylene-vinyl acetate copolymer (30) | Natural resin modified maleic resin (70) | about 40 | 0.36 | 1.41 | 0.04 |
| 5 | Ethylene-vinyl acetate copolymer (40) | Natural resin modified glycerine resin (60) | about 90 | 0.37 | 1.53 | 0.03 |
| 6 | Ethylene-vinyl acetate copolymer (50) | Natural resin modified pentaerythritol resin (50) | about 55 | 0.27 | 1.49 | 0.02 |
| 7 | Low molecular weight polyethylene (30) | Natural resin modified pentaerythritol resin (70) | about 70 | 0.28 | 1.46 | 0.03 |
| 8 | Low molecular weight polyethylene (40) | Natural resin modified maleic resin (60) | about 30 | 0.09 | 1.59 | 0.02 |
| 9 | Low molecular weight polyethylene (50) | Natural resin modified glycerine resin (50) | about 50 | 0.15 | 1.72 | 0.03 |
| 10 | Low molecular weight polyethylene (60) | Natural resin modified maleic resin (40) | about 40 | 0.12 | 1.51 | 0.02 |
| | Low molecular | Natural resin | | | | |

-continued

| Example No. | Resin of Group A (parts by weight) | Resin of Group B. (parts by weight) | Smoothness of transferring paper | Fixability | Image density | Fog density |
|---|---|---|---|---|---|---|
| 11 | weight polypropylene (30) | modified glycerine resin (70) | about 100 | 0.36 | 1.50 | 0.04 |
| 12 | Low molecular weight polypropylene (40) | Natural resin modified pentaerythritol resin (60) | about 50 | 0.24 | 1.61 | 0.03 |
| 13 | Low molecular weight polypropylene (50) | Natural resin modified maleic resin (50) | about 65 | 0.17 | 1.55 | 0.03 |
| 14 | Ionomer resin (30) | Natural resin modified maleic resin (70) | about 110 | 0.35 | 1.72 | 0.03 |
| 15 | Ionomer resin (40) | Natural resin modified glycerine resin (60) | about 30 | 0.21 | 1.62 | 0.02 |
| 16 | Ionomer resin (50) | Natural resin modified pentaerythritol resin (50) | about 40 | 0.17 | 1.56 | 0.02 |

Comparison test was carried out by changing the combination and amount of the resin and smoothness of the transferring paper which are shown in the following table.

| Comparison Example | Resin of Group A (parts by weight) | Resin of Group B (parts by weight) | Smoothness of transferring paper | Fixability | Image density | Fog density |
|---|---|---|---|---|---|---|
| 1 | Ethylene-ethyl acrylate copolymer (15) | Natural resin modified maleic resin (85) | about 40 | 0.55 | 1.02 | 0.25 |
| 2 | Ethylene-ethyl acrylate copolymer (85) | Natural resin modified maleic resin (15) | about 40 | 0.12 | 0.72 | 0.02 |
| 3 | Low molecular weight polyethylene (15) | Natural resin modified pentaerythritol resin (85) | about 60 | 0.61 | 0.99 | 0.31 |
| 4 | Low molecular weight polyethylene (85) | Natural resin modified pentaerythritol resin (15) | about 60 | 0.10 | 0.85 | 0.03 |
| 5 | Ionomer resin (15) | Natural resin modified glycerine resin (85) | about 90 | 0.57 | 1.01 | 0.26 |
| 6 | Ionomer resin (85) | Natural resin modified glycerine resin (15) | about 90 | 0.13 | 0.78 | 0.04 |
| 7 | Ionomer resin (50) | Natural resin modified glycerine resin (50) | about 250*1 | 0.52 | 1.62 | 0.03 |
| 8 | Ethylene-vinyl acetate copolymer (30) | Natural resin modified maleic resin (70) | about 150*2 | 0.54 | 1.42 | 0.04 |
| 9 | Low molecular weight polypropylene (50) | Natural resin modified pentaerythritol resin (50) | about 1100*3 | 0.89 | 1.56 | 0.05 |
| 10 | Ethylene-ethyl acrylate copolymer (40) | Natural resin modified maleic resin (60) | about 220*2 | 0.47 | 1.71 | 0.03 |
| 11 | Low molecular weight polyethylene (40) | Natural resin modified maleic resin (60) | about 300*1 | 0.49 | 1.68 | 0.03 |

Note:
*1Coated paper
*2High quality paper
*3Art paper

The data in Comparison Examples 1, 3 and 5 shows that when the amount of the resin of Group A is far smaller than that of the resin of Group B, the pressure fixability of the image is extremely deteriorated. Further, it is shown that the image density is decreased and fog density is increased since the chargeability of the toner is poor.

Comparison Examples 2, 4 and 6 relates to the case in which the amount of the resin of Group B is far smaller than the resin of Group A. As such a combination of the resins is difficult to grind, the cooling grinding was conducted, but the yield of the toner was extremely decreased. Further, since the agglomeration property of the toner is strong, only an unclear image having a lower image density can be obtained, which is understood from the data in those Comparison Examples.

The data in Comparison Examples 7–11 indicates that even in case of using the toner of the invention, employing a transferring paper having a smoothness of more than 130 seconds results in considerable decrease in the pressure fixability of the image.

EXAMPLE 17

In Examples 1–16, 10–40 parts by weight of either polystyrene or polyester resin was additionally incorporated as the binder resin to prepare toners.

The thus prepared toners were used in the same copying test operation as that in Example 1. As a result, the pressure fixability of the obtained image was somewhat deteriorated, but the chargeability and stability of the toner during repeated use were enhanced so that a clear, fogless image was obtained.

EXAMPLE 18

100 parts by weight of the toner particle prepared in Examples 1–16 were mixed, respectively, with 10 parts by weight of hydrophobic silica fine particles (trade name: R-972, supplied by Japan Aerosil K. K.). The resulting mixture was placed in a vessel for forming a fluidized bed of the mixture. The body of the vessel is substantially in a cylindrical shape, and its bottom is formed of a porous metal plate through which air is blown. The porous metal plate is provided with a silk screen to prevent the powder in the vessel from falling down through a hole of the metal plate when air is not blown. The lid of the vessel is provided with a back filter.

Air heated at a room temperature was blown into the vessel from the bottom plate while the air blow was controlled so as to form an appropriate fluidized bed. The air was gradually heated so that the air in the inlet of the bottom was retained at 85°–90° C. for 5 minutes. Heating was stopped to allow the air to cool up to a room temperature. The thus treated powder was classified to select that having a particle size of 5–20 microns.

The obtained toner was almost spherical in the shape, and particularly showed excellent fluidity property.

With the toner, 30,000 sheets of copy was made continuously so that clear, fogless images were obtained. The fixability of the images was practically satisfactory.

In this example, the hydrophobic silica fine particle can be adhered to the surface of the toner, also in such a manner that the temperature of the air in the inlet of the vessel is controlled to be about 80°–150° C. and the fluidized bed is retained for about 0.5–10 minutes.

In the above mentioned examples, the used ethylene-ethyl acrylate copolymer is DPDJ-6169, a trade name, supplied by Nippon Unicar K. K.

The used low molecular weight polyethylene is SANWAX-151P, trade name, supplied by Sanyo Kasei Kogyo. And, SANWAX-E300, trade name, supplied by the same company may be preferably used.

The employed low molecular weight polypropylene is VISCOL-550P, trade name, supplied by Sanyo Kasei Kogyo.

The ionomer resin is ethylene system resin containing a metal ion in the molecule, and SURLYN-1706, trade name, supplied by Mitsui Polychemical was used. SURLYN-1652, trade name, supplied by the same company may be also preferably employed.

The used ethylene-vinyl acetate copolymer is EVAFLEX-220, trade name, supplied by Mitsui Polychemical. EVAFLEX-250, trade name, supplied by the same company may be also preferably employed.

The used natural resin modified meleic acid resin is rosin modified moleic acid resin (BECKACITE-1110, trade name, supplied by Japan Reichhold Chemical Inc.), and BECKACITE-1111, trade name, supplied by the same company may be also preferably used.

The used natural resin modified pentaerythritol resin is rosin modified pentaerythritol resin (PENTACITE-P423, trade name, supplied by Japan Reichhold Chemical Inc.).

The natural resin modified glycerine resin is rosin modified glycerin resin (ESTERGUM-H, trade name, supplied by Arakawa Kagaku Kogyo K.K.).

What we claim is:

1. An electrophotographic process which comprises the steps of:

developing an electric latent image with a dry developer comprising toner particles, the toner particles comprising 20–70 parts by weight of at least one Group A resin and 80–30 parts by weight of at least one Group B resin;

transferring the developed toner image to a paper having a smoothness of 5–130 seconds (measured by Bekk method);

fixing the transferred toner image on said paper by applying pressure; and wherein said Group A resin is selected from the group consisting of a low molecular weight polyethylene, a low molecular weight polypropylene, ethylene-ethyl acrylate copolymer, ionomer resin and ethylene-vinyl acetate copolymer, and said Group B resin is selected from the group consisting of natural resin modified maleic acid resin, natural resin modified pentaerythritol resin and natural resin modified glycerine resin.

2. An electrophotographic process according to claim 1, in which said toner particle comprises 25–50 parts by weight of at least one resin selected from resins of Group A and 75–50 parts by weight of at least one resin selected from resins of Group B.

3. An electrophotographic process according to claim 1, in which said paper has a smoothness of 10–90 seconds.

4. An electrophotographic process according to claim 1, in which the total amount of the resins of Groups A and B is larger than 60% by weight based on the weight of the binder resin for the toner.

5. An electrophotographic process according to claim 1, in which said toner particles have hydrophobic silica fine particles fixed on the surface thereof.

6. An electrophotographic process according to claim 1, in which said toner particles contain magnetic fine particles.

* * * * *

UNITED STATES PATENT AND TRADEMARK OFFICE

CERTIFICATE OF CORRECTION

PATENT NO. : 4,206,247

DATED : June 3, 1980

INVENTOR(S) : YASUO MITSUHASHI, ET AL

It is certified that error appears in the above—identified patent and that said Letters Patent is hereby corrected as shown below:

Column 1, Lines 29-30, "includes" should be --include--;

Column 2, Line 1, after "takes" insert --a--;

Column 3, Line 6, "in", first occurrence, should be --is--;

Column 4, Lines 29-30, the heading "DESCRIPTION OF THE PREFERRED EMBODIMENTS" should be apart from the other text at line 29 and between lines 29 and 31;

Column 4, Lines 38-39, "decrease" should be --decreasing--;

Column 4, Line 60, "speficied" should be --specified--;

Column 8, Line 10, "an" should be --a--;

Column 8, Line 16, after densimeter delete "to";

Column 8, Line 29, "replace" should be --replaced--;

Column 12, Line 10, "meleic" should be --maleic--;

Column 12, Line 11, "moleic" should be --maleic--.

UNITED STATES PATENT AND TRADEMARK OFFICE

CERTIFICATE OF CORRECTION

PATENT NO. : 4,206,247

DATED : June 3, 1980

INVENTOR(S) : YASUO MITSUHASHI, ET AL

It is certified that error appears in the above—identified patent and that said Letters Patent is hereby corrected as shown below:

In the Table at the bottom of Columns 7 and 8, last line thereof, delete "Low molecular" and "Natural resin"; in the continuation of said Table at the top of Columns 9 and 10, immediately under the heading "Resin of Group A (parts by weight)" and above the first line "weight polypro-", insert --Low molecular-- and immediately under the heading "Resin of Group B (parts by weight)" and above the first line "modified glyce-", insert --Natural resin--.

Signed and Sealed this

*Fourteenth* Day of *October 1980*

[SEAL]

*Attest:*

SIDNEY A. DIAMOND

*Attesting Officer*

*Commissioner of Patents and Trademarks*